United States Patent [19]

Nilsson

[11] Patent Number: 4,662,148

[45] Date of Patent: May 5, 1987

[54] METHOD AND APPARATUS FOR THE APPLICATION OF FILM WRAPPINGS

[75] Inventor: Lennart Nilsson, Lund, Sweden

[73] Assignee: Tetra Pak International AB, Lund, Sweden

[21] Appl. No.: 727,788

[22] Filed: Apr. 26, 1985

[30] Foreign Application Priority Data

May 4, 1984 [SE] Sweden ..... 8402405

[51] Int. Cl.[4] ..... B65B 13/02

[52] U.S. Cl. ..... 53/399; 53/466; 53/586; 53/228; 53/548

[58] Field of Search ..... 53/55, 220, 228, 463, 53/466, 548, 557, 586, 397, 398, 399, 207, 209, 229, 230

[56] References Cited

U.S. PATENT DOCUMENTS

| | | | |
|---|---|---|---|
| Re. 28,535 | 9/1975 | Ganz | 53/398 |
| 3,564,810 | 2/1971 | Faletti et al. | 53/466 X |
| 3,704,566 | 12/1972 | Zimmerman | 53/466 X |
| 3,815,313 | 6/1974 | Heisler | 53/466 X |
| 4,215,525 | 8/1980 | Nigrelli | 53/209 X |
| 4,250,692 | 2/1981 | Uchida | 53/586 X |
| 4,250,693 | 2/1971 | Andersson | 53/207 X |
| 4,313,288 | 2/1982 | Tassi et al. | 53/229 X |
| 4,315,394 | 2/1982 | Noack | 53/229 X |
| 4,443,955 | 4/1984 | Meyers et al. | 53/466 X |
| 4,525,977 | 7/1985 | Matt | 53/55 |

FOREIGN PATENT DOCUMENTS

| | | |
|---|---|---|
| 2836552 | 3/1980 | Fed. Rep. of Germany . |
| 7411547 | 5/1979 | Sweden . |
| 1033374 | 8/1983 | U.S.S.R. . |

*Primary Examiner*—Robert L. Spruill
*Assistant Examiner*—Steven P. Weihrouch
*Attorney, Agent, or Firm*—Burns, Doane, Swecker & Mathis

[57] ABSTRACT

In the application of preprinted film wrappings around packing containers it is sometimes required that the text or decorative pattern of the wrapping should be located in a certain position in relation to the edges of the finished packing container. A method of film wrapping around an object, e.g. a packing container, is described in which a film web is joined to a waste material web and is advanced with the help of this until the decoration is situated in a predetermined position. Subsequently the packing containers are wrapped while the film web is delivered from a film roll whereupon the sealing is performed on a previously unused part of the film web. Apparatus for carrying out the method is described which comprises co-operating sealing jaws and a conveyor consisting of two parallel parts.

15 Claims, 7 Drawing Figures

1
2
15
16
17
19
20
21
24
25
27
28
29

METHOD AND APPARATUS FOR THE APPLICATION OF FILM WRAPPINGS

BACKGROUND OF THE INVENTION

The present invention relates to methods and apparatus for the application of a film wrapping around an object.

Packages, packing containers or other consumer goods or objects which are to be provided with text, pictures or other decorations frequently are manufactured with an uncoloured or single-coloured outside whereafter the desired decoration is applied in the form of a preprinted label or film. For this purpose e.g. a so-called shrink-film may be used, that is to say a film of a heat-shrinkable material, e.g. PVC-plastics. The film is applied in the form of a loose wrapping around the object, whereafter it is heated to a temperature initiating shrinkage, and this is done generally by introducing the wrapped object into an oven. The wrapping will then adapt itself to the outer shape of the object and shrink until it is in a close fit against the same. In this manner not only an outer decoration of high quality is obtained, but also a wrapping protecting and strengthening the object which, moreover, through appropriate design may represent a seal, that is to say indicate whether the object has been tampered with or whether e.g. the package has been left opened.

Since preprinted wrappings of shrink-film are used among other things for consumer packages where appearance and finish are of great importance, it is desirable to be able to apply the film in a predetermined positional orientation which is such that the decoration will be in the correct position on the packing container. This has proved difficult with known methods and arrangements, however, especially when high machine speeds are desirable.

In the case of consumer packages where appearance is of major importance, it is also desirable to minimize the number of seals on the wrapping. In conventional wrappings in shrink-film use is made ofter of two material webs which are sealed together in such a manner that each forms one half of the wrapping. Each wrapping will then have two seals which are situated substantially opposite each other. This can be accepted when undecorated shrink-film is used for holding together and protecting a large number of individual consumer packages in so-called collective packages, but when the shrink-film wrapping is used for decorative purposes it should present only one seal which, moreover, should be placed in such a position that any disturbing effect on the appearance of the packing container is kept to a minimum. This has not been possible by means of known methods and arrangement.

OBJECTS AND BRIEF SUMMARY OF THE INVENTION

It is an object of the present invention to provide a method and an arrangement for the application of a film wrapping around an object, this method and arrangement being suitable for the range of application described above without being subject to the aforementioned disadvantages.

It is a further object of the present invention to provide a method of application which makes it possible to apply the film wrapping in an accurate manner and at high speed in the desired positional orientation to objects passing in succession.

It is a further object of the present invention to provide apparatus for the realization of the aforementioned method, this apparatus being of a simple design and low manufacturing and operating costs.

It is a further object of the present invention to provide apparatus for the application of the film wrapping that is of simple function and high working speed and being highly suitable, therefore, for use together with modern high-capacity packing machines.

These and other objects have been achieved in accordance with the invention object by supplying the film in form of a web from a roll, wrapping the web in a loop around the object and sealing it to itself. Upon sealing, the film web is joined to a waste material web which, after separation of the loop from the web, is used for drawing the film web forward over such a distance that the subsequent sealing can take place on a previously unused part of the film web.

The apparatus in accordance with the invention includes a conveyor for the objects, a path of feed for the film web crossing the same and elements for the sealing and separating of the film web. The elements for the sealing and separating of the film web comprise cooperating jaws arranged on opposite sides of the conveyor which are movable in respect of each other mainly along a part of the part of feed of the film web and are placed behind the same viewed in the direction of movement of the conveyor.

The method and the apparatus in accordance with the invention make possible the wrapping of objects in preprinted shrink-film with a precision and speed previously unknown. The wrapping receives only one joint which, moreover, can be located in a position appropriate from an aesthetic point of view, e.g. at the back of the packed object. The method and the apparatus in accordance with the invention are particularly suitable for the application of preprinted shrink-film serving as a label and strengthening around individual packing containers.

BRIEF DESCRIPTION OF THE DRAWINGS

A preferred embodiment of the method and the apparatus in accordance with the invention is described in detail with reference to the attached drawings, in which.

DETAILED DESCRIPTION

Figure 1:
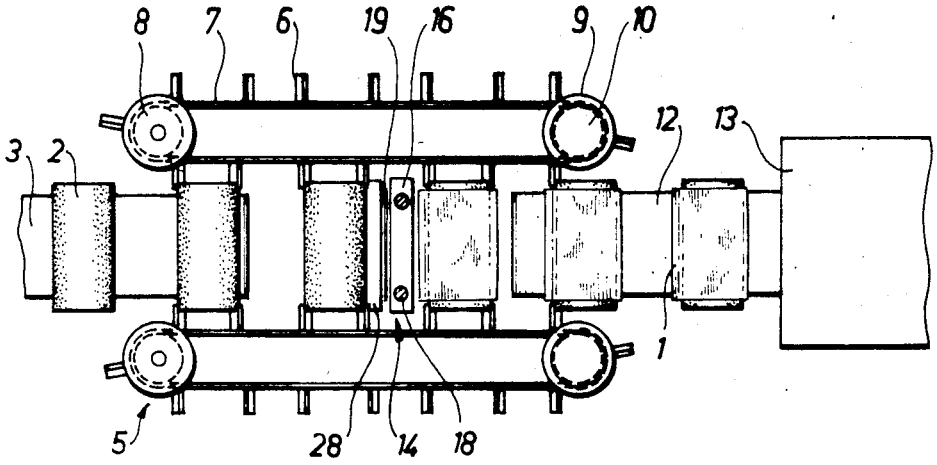
FIG. 1 is a top plan view of the apparatus in accordance with the invention.
Figure 2:
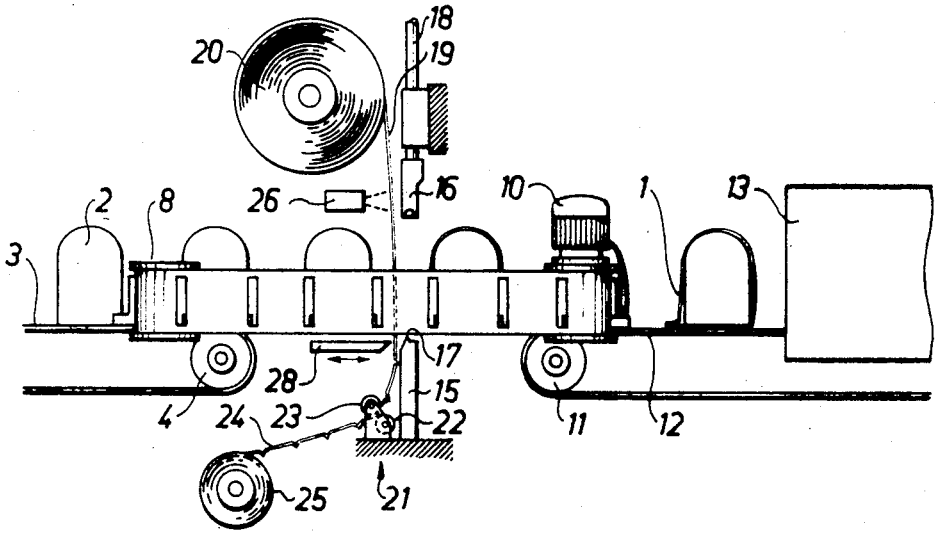
FIG. 2 is a side elevational view of the apparatus shown in FIG. 1.

The apparatus in accordance with the invention shown in FIGS. 1 and 2 is intended for the application of the film wrapping 1 to each packing container 2. The packing containers 2 are manufactured by a packing machine, not shown, which supplies the containers via a first conveyor belt 3. The first conveyor belt 3 is driven by means of a drive unit, not shown, and travels over a pulley 4 which is supported so that it can freely rotate on a horizontal center axle. In the path of the first conveyor belt 3 and slightly above the same there is a conveyor 5 which comprises two parts located on either side of the path of feed of the packing containers. Both of the conveyors 5 have an endless belt 7 which is with drivers 6. The belt 7 travels over pulleys 8 which freely rotate about vertical center axles, and are situated on either side of the pulleys 4. At the opposite end of the conveyor 5 there are further pulleys 9 which are connected to drive units 10 which may consist, for example, of electric motors. They drive the two belts 7 in opposite directions, that is to say their active parts facing each other move from left to right in FIGS. 1 and 2. Between the pulleys 9, and slightly below them, there is a pulley 11 for a second conveyor belt 12 which with its upper active part enters into a shrinkage oven 13 of conventional hot-air or IR type.

Between the two conveyor belts 7 provided with drivers of the conveyor 5 there are sealing and separating elements 14. (FIG. 1). The sealing and separating elements comprise two sealing and separating jaws 15,16 which are located respectively below and above the conveyor 5. Both jaws 15,16 have elongated working surfaces directed towards each other which extend horizontally and transversely in relation to the conveyor 5. One jaw (e.g. the bottom jaw 15) has an electrically heatable edge 17 situated centrally in the working surface. The opposite jaw 16 has a substantially plane working surface whose central part presents a resilient area which, for example, may consist of flexible material (rubber) adapted to co-operate with the heatable knife edge 17. The working surface of the jaw 15 is provided moreover with internal ducts for cooling fluid e.g. cold water. This jaw construction is conventional and is frequently used in known shrink-film wrapping machines, so that it is not described or shown in detail in this connection.

The separating jaw 16 located above the conveyor 5 is supported by the machine frame and is reciprocally movable in vertical direction along guides 18. The jaw is driven in a conventional manner e.g. by means of a cam unit or with the help of a piston and cylinder unit. The driving of the jaw 16 is synchronized with the intermittent driving of the conveyor 5 so as to ensure that the jaw 16 is moved to make contact with the fixed jaw 15 only when the conveyor 5 is at standstill and is in such a position that the jaw 16 can be moved freely in the space between the conveyor belt 7 and the packing containers 2 transported by the conveyor 5.

Adjoining the two sealing jaws 15,16 a film web 19 extends in a substantially vertical direction. The film web 19 comes from a roll 20 of film material and is led via guide rollers, not shown, down between the two parts of the conveyor 5 to a web feed element 21 which is situated close to the fixed jaw 15 where it is supported by the machine frame. The web feed element 21 comprises a roller 22 provided with a stepping motor and a counter-roller 23 co-operating with it. The rollers are driven step-by-step in rhythm with the working stroke of the movable jaw 16, the web of excess material (called waste material web 24, which will be explained in detail in the following) located in the nip between the roller being fed to a waste material roll 25. The drive of the roller 22 which is provided with the stepping motor is controlled electronically by means of elements, not shown, which are connected to a sensing device in the form of a photocell 26 which is situated close to the film web 19 and which senses suitably placed photocell markings in the decorative pattern of the web.

During operation of the arrangement in accordance with the invention packing containers 2 are fed at uniform intervals along the upper active portion of the conveyor belt 3. The packing containers are delivered one by one between the two belts 7 of the conveyor 5 where they are gripped by co-operating pairs of drivers 6. The drivers are designed as short angles projecting from the belt 7 which grip around opposite bottom corners of the packing containers so that the packing containers are moved at intervals from left to right in FIGS. 1 and 2.

Figures 3A, 3B, 3C, 3D, 3E:
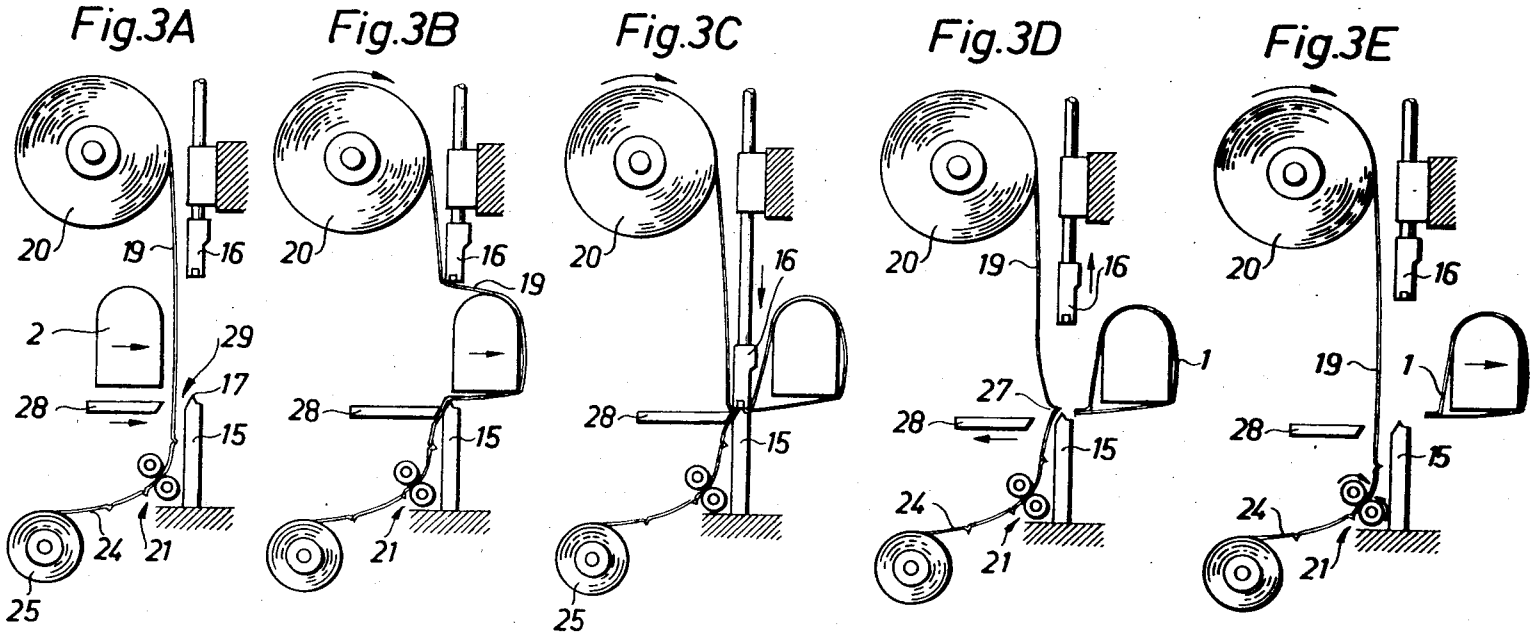
FIGS. 3A to E inclusive show schematically and step-by-step the application of a film wrapping around an object in accordance with the invention.

When a packing container 2 approaches the sealing and separating elements 14 and the film web 19, the jaws 15,16 are in open position (FIG. 3A). On continuing its advance the packing container 2 makes contact with the film web 19 causing it to be wound off the film roll 20 which is supported so that it can freely rotate. The two rollers 22,23 constituting the web feed element 21 are in constant engagement with each other and with the waste material web 24 located between thus preventing the latter from being pulled back from the waste roll 25 as the film web is pulled forward. The length of film required for the wrapping of the packing container 2 is thus wound off exclusively from the film roll 20 (FIG. 3B).

When the packing container 2 passes between the open jaws 15,16 the movable jaw 16 commences to move downwards which causes further film web 19 to be wound off the roll 20. The film web slides against the working surface of the movable jaw 16 until the two jaws have made contact (FIG. 3C). In this position the movement of the conveyor 5 has been stopped and the packing container 2 is enveloped completely by a film loop whose ends are between the working surfaces of the two jaws 15,16. The edge 17 of the fixed jaw 15 is heated to, and maintained at, the desired temperature so that through joint action with the surrounding jaw surfaces and the resilient counterelement of the movable jaw 16 on the one hand the parts of the film web lying against each other are melted and fused together and on the other hand the part of the web used for formation of the loop (wrapping) is separated from the remaining film material web. As a result of this design of the jaws, a welding together of the material loop placed around the packing container is achieved, so that a film wrapping 1 is obtained, and in the same operation a welding together of the film web 19 with the waste material web 24 and finally a separation between the welding spots of the wrapping from the material web are taking place.

When the operation has been completed, the sealing and separating jaws 15,16 are moved back again by returing the jaw 16 to its upper rest position (FIG. 3D). At the same time the web feed element 21 is activated so that the waste material web 24 and the film web 19 connected to the same are advanced over a distance which is such that the material joint 27 produced in the sealing is drawn slightly below the working surface of the lower jaw 15 so as not to be in the way of the following sealing operation. This is essential because the sealing joint made earlier forms a thickening of partly irregular shape on the web which makes impossible a further sealing at the same spot. With the help of the sensing device or photocell 26 (FIG. 2) mentioned earlier it is ensured at the same time that the film web 19 is drawn forward to such a position that its text or decorative pattern is in the correct position for application in register with the shape of the following packing container. This can be done with great exactness, since during the whole procedure the web feed element is in engagement with the web so that the position of the latter cannot accidentally be altered. The arrangement is now ready for the application of a film wrapping around the next packing container and the conveyor 5 is started again therefore for advancing the packing containers by a further step (FIG. 3E and FIG. 3A), whereupon the cycle is repeated until the desired number of packing containers have been provided with shrink-film wrapping.

In order to reduce the strain on the latest produced material joint 27 of the waste material web 24, the arrangement in accordance with the invention may also be provided with a clamping means 29 (FIG. 3A), which is arranged to hold the waste material web 24 during the forward fed of the object. The clamping means 29 comprises a clamping finger 28, which after the forward feeding of the waste material web 24 clamps the web against the fixed jaw 15. The clamping finger is movable to and fro, and when it is in its retracted or open position the feed element 21 can freely pull the waste material web 24 forward. When the clamping finger is in closed position backwards movement of the web is prevented, as the waste material web 24 is clamped between the clamping finger 28 and the fixed jaw 15 at or immediately after the latest produced material joint. In this way the strain in the web caused by the forward feeding of the web is prevented from reaching the sealing joint when this still is in a hot state, which considerably reduces the risk for the web to brake in the joint area. The arrangement is particularly useful in combination with high production rates.

After the packing containers 2 have been enclosed in a film wrapping 1, they are transferred to the second conveyor belt 12 (FIGS. 1, 2) which conducts the packing containers provided with wrapping at a suitable speed into the shrinkage over 13 where the shrink-film is heated to such a temperature that shrinkage is initiated and the film is made to fit tightly to the outer form of the packing containers. The packing containers provided with wrapping are now ready, and can be moved on further e.g. to be packed in collective containers and dispatched.

The method and apparatus in accordance with the invention described have proved to function well in practice and make possible the wrapping of packing containers at a rate of approx. 8000 per hour. If a higher speed is required, it is possible to attach the sealing and separating elements 14, the web feed element 21 and the guide rollers for the film web to a reciprocating carriage which in the working and return stroke moves in rhythm with the conveyor 5, so that the latter can be driven continuously instead of intermittently. As a result it is theoretically possible to obtain a rate of manufacture of nearly 12,000 packages per hour.

While the invention has been illustrated and described in accordance with a preferred embodiment, it is recognized that variations and changes may be made therein without departing from the invention, as set forth in the claims.

What is claimed is:

1. A method for applying heat sealable film in the form of a web in a loop around an object and sealing the looped web to itself, comprising the steps of: advancing the object along a first path, supplying said web from a source, guiding said web along a feed path across said first path in position to be engaged by said object so that said web is looped around the object and overlaps itself, during said looping step temporarily clamping a portion of said web against a fixed sealing jaw at a location opposite of said first path from said source, during said looping step moving a second sealing jaw into a working position with said fixed sealing jaw to seal the overlapping portions together and to separate said web at the overlap location whereby a transverse sealed region is formed in the web remaining along said feed path, and subsequently advancing the web remaining along said feed path a predetermined distance so that said transverse sealed region is advanced from said working position to a position along said feed path beyond said clamping location.

2. The method in accordance with claim 1, including the step of controlling said step of advancing said web according to a pattern situated on the web.

3. The method according to claim 1, including supplying said web from a feed roll above said path, and taking up said web on a waste roll below said path.

4. The method in accordance with claim 3, wherein the web is held tight during the loop formation.

5. The method in accordance with claim 1, wherein the loop formation takes place when the film web and the object are moved relative to each other.

6. The method in accordance with claim 1, wherein the objects are fed intermittently, the sealing and separating operations taking place with the object is stationary.

7. The method in accordance with claim 1, wherein a plurality of objects are fed continuously, said sealing and separating operations being synchronized with the movement of the objects.

8. An apparatus for applying a heat sealable web around an object, comprising:

means for conveying said objects along a conveyance path;

means for intermittently feeding said web from a source along a feed path, said source located on one side of said conveyance path, said feed path crossing said conveyance path at a first location;

means for temporarily clamping said web against a fixed member at a location along said feed path on an opposite side of said conveyance path from said source; and means for sealing and separating said web, said sealing and separating means at a second location further along said conveyance path than said first location and including a fixed jaw on said opposite side of said conveyance path, a second jaw on said one side of said conveyance path and means for moving said second jaw into a working position adjacent said first jaw, said clamping means clamping the web against said first jaw at a clamping location, said first and second jaws at their working position adapted to form a transverse sealed region in the web remaining along said feed path;

said intermittently feeding means feeding said web according to a predetermined length greater than a distance between said clamping location and said working position so that each sealed region formed at said working position is moved by said intermittently feeding means from said working position to a location along said feed path beyond said clamping location.

9. The apparatus in accordance with claim 8, wherein said intermittent feeding means includes photo-electric means for controlling feedlength of said web according to a pattern on said web.

10. An apparatus for applying a heat sealable web around an object, comprising:

means for conveying said objects along a first side of a horizontal conveyance path;

a fixed first sealing jaw at a first location along said conveyance path on the opposite side of said conveyance path;

a second sealing jaw at said first location along said conveyance path on said first side of said conveyance path;

means for intermittently feeding said web along a vertical feed path from a source located on said first side of said conveyance path, said feed path crossing said conveyance path at a second location on said conveyance path adjacent to and preceding said first location so that a portion of said feed path is adjacent said first sealing jaw;

means for vertically reciprocating said second sealing jaw between a working position and a retracted position, said second sealing jaw at said retracted position being spaced from said conveyance path, whereby an object being moved along said first feed path may pass beneath said second sealing jaw and through said feed path so that said web loops around said object and overlaps itself, said second sealing jaw at said working position being adjacent to said first sealing jaw, said first and second sealing jaws adapted to thermally seal together overlapping portions of the web and to transversely cut said web so that longitudinally spaced sealed regions are formed in the web remaining along said web path; and means for temporarily clamping said web against said first sealing jaw, said intermittent feeding means feeding said web according to a predetermined length greater than a distance between said working position and said clamping means so that each sealed region formed at said working position is moved by said intermittently feeding means from said working position to a location along said feed path beyond said clamping means.

11. The apparatus in accordance with claim 10, wherein said intermittent feeding means includes opposing rollers in continuous engagement with the web.

12. The apparatus in accordance with claim 10, wherein said intermittent feeding means includes a device sensing a pattern on the web.

13. The apparatus in accordance with claim 12, wherein the sensing device includes a photocell.

14. The apparatus in accordance with claim 10, wherein said sealing and separating means are supported on a carriage which is reciprocally movable along the conveyor.

15. The apparatus in accordance with claim 10 wherein the conveyor includes two parallel conveyor belts having opposing drivers, said conveyance path being between said opposing drivers.

* * * * *